US009458594B2

(12) United States Patent
Brookhart et al.

(10) Patent No.: US 9,458,594 B2
(45) Date of Patent: Oct. 4, 2016

(54) SYSTEM AND METHOD FOR RETAINING WALL

(71) Applicant: Oldcastle Precast, Inc., Auburn, WA (US)

(72) Inventors: Clinton Brookhart, Littleton, CO (US); Robinson Usagani, Littleton, CO (US)

(73) Assignee: Oldcastle Precast, Inc., Auburn, WA (US)

( * ) Notice: Subject to any disclaimer, the term of this patent is extended or adjusted under 35 U.S.C. 154(b) by 0 days.

(21) Appl. No.: 14/472,128

(22) Filed: Aug. 28, 2014

(65) Prior Publication Data

US 2015/0063924 A1 Mar. 5, 2015

Related U.S. Application Data

(60) Provisional application No. 61/871,133, filed on Aug. 28, 2013.

(51) Int. Cl.
*E02D 29/02* (2006.01)

(52) U.S. Cl.
CPC ..... *E02D 29/0266* (2013.01); *E02D 29/02* (2013.01)

(58) Field of Classification Search
CPC .. E02D 29/02; E02D 29/0266; E02D 29/025
USPC ..... 405/262, 284, 286, 302.4, 302.6, 302.7; 52/603–608, 112
See application file for complete search history.

(56) References Cited

U.S. PATENT DOCUMENTS 4,668,129 A 5/1987 Babcock et al.
4,824,293 A 4/1989 Brown et al.
5,257,880 A * 11/1993 Janopaul, Jr. ..... E02D 29/025 405/284
5,308,195 A 5/1994 Hotek
D350,611 S 9/1994 Scales
5,417,523 A * 5/1995 Scales ..... E02D 29/0241 405/262
5,540,525 A * 7/1996 Miller ..... E02D 29/025 405/284
5,711,130 A 1/1998 Shatley
D403,437 S 12/1998 Risi et al.
6,000,183 A 12/1999 Newman
6,019,550 A * 2/2000 Wrigley ..... E02D 29/0241 405/262
6,250,850 B1 6/2001 Price et al.
6,253,518 B1 7/2001 Azar
6,287,054 B1 * 9/2001 Egan ..... E02D 29/0241 405/262
D466,228 S 11/2002 Hammer
6,557,818 B2 * 5/2003 Manthci ..... B28B 7/0044 249/101
D477,091 S 7/2003 Manthei
D477,419 S 7/2003 Manthei
D479,002 S 8/2003 Nordstrand
D479,003 S 8/2003 Nordstrand
6,652,196 B1 11/2003 Rainey
6,679,656 B1 * 1/2004 Manthei ..... E02D 29/0241 403/347
D486,246 S 2/2004 Manthei
6,695,544 B2 2/2004 Knudson et al.
2001/0019684 A1 * 9/2001 Manthei ..... E02D 29/025 405/284

(Continued)

*Primary Examiner* — Sunil Singh
(74) *Attorney, Agent, or Firm* — Sheridan Ross P.C.

(57) ABSTRACT

A retaining wall system for mechanically stabilizing an earthen wall is provided. The system comprises a plurality of modular block members that may be assembled in a number of desired states or orientations. Tieback members for supporting the wall and related fill are provided and the wall comprises interconnection members for the tieback members.

6 Claims, 14 Drawing Sheets

(56) References Cited

U.S. PATENT DOCUMENTS

2003/0012608 A1* 1/2003 Race ..... E02D 29/0241 405/284
2004/0052588 A1 3/2004 Keshmiri
2008/0085162 A1* 4/2008 Blundell ..... E02D 29/0266 405/284
2011/0192097 A1* 8/2011 Kelley, Jr. ..... E02D 29/0225 52/166
2014/0314501 A1 10/2014 Usagani

* cited by examiner

SYSTEM AND METHOD FOR RETAINING WALL

This U.S. Non-Provisional Patent Application claims priority to U.S. Provisional Patent Application Ser. No. 61/871,133, filed Aug. 28, 2013, the entire disclosure of which is hereby incorporated by reference in its entirety.

FIELD OF THE INVENTION

The present invention relates generally to retaining wall systems. More specifically, the present invention relates to a unique mechanically stabilized earth retaining wall block system and method of use thereof.

BACKGROUND

Known retaining wall structures, including those disclosed in U.S. Pat. No. 4,824,293 to Brown et al., which is hereby incorporated by reference in its entirety, fail to disclose various features of the present invention. Brown et al. provide an elongated slit on one side of a panel, but fail to disclose various features of the present invention as shown and described herein, including members, anchor members, and attachment means of the present invention.

U.S. Pat. No. 4,668,129 to Babcock et al., U.S. Pat. No. 5,308,195 to Hotek, and U.S. Pat. No. 6,652,196 to Rainey, which are hereby incorporated by reference in their entireties, similarly fail to disclose various novel features, devices, and methods of the present invention. For example, known devices and systems fail to provide methods and systems for fast and secure connection of tiebacks to a wall panel while reducing risk of damaging or spalling or damaging the panel.

SUMMARY OF THE INVENTION

In view of the limitations now present in the prior art systems and methods for mechanically stabilized earthen retaining walls, the present invention provides a new and useful mechanically stabilized earth retaining wall block system and method of use thereof which is simpler in fabrication, more universally functional and more versatile in application and operation than known prior art methods or devices.

A purpose of the present invention is to provide a new mechanically stabilized earth retaining wall block system and method of use thereof that may be used as a retaining wall to stabilize unstable slopes and retain the soil on steep slopes. It is also a purpose of the present invention to provide a new mechanically stabilized earth retaining wall block system and method of use thereof that has many novel features not offered by the prior art, that result in a new and novel mechanically stabilized earth retaining wall block system which is not apparent, obvious, or suggested, either directly or indirectly by any of the prior art devices, apparatus, or methods.

In one embodiment of the present invention, a retaining wall system is provided, the system comprising a plurality of block members adapted to be assembled to form a retaining wall of a desired orientation. The plurality of block members comprise an inner face adapted for retaining a fill material, an outer face, an upper end, a lower end and a predetermined thickness between said inner and outer face. The upper end comprises an elongate channel when said plurality of block members are provided in an assembled state, and a reinforcing member is provided that extends away from said plurality of block members. The reinforcing member, the elongate channel, and the plurality of block members are provided in force transmitting communication, and at least one of said plurality of block members comprises a projection adapted for interconnection with at least a second block member.

In another embodiment, a retaining wall system is provided, the system comprising a plurality of block members adapted to be assembled to form a retaining wall of a desired orientation. The plurality of block members comprise an inner face adapted for retaining a fill material, an outer face, an upper end, a lower end and a predetermined thickness between said inner and outer face. The upper end comprises an elongate channel when said plurality of block members is provided in an assembled state. A reinforcing member is provided that extends away from the plurality of block members, and the reinforcing member, the elongate channel, and plurality of block members are provided in force transmitting communication. At least one connecting anchor is provided to secure the reinforcing member to the plurality of block members, and the connecting anchor extends through at least a portion of the reinforcing member.

In yet another embodiment of the present invention, a modular retaining wall system is provided, the system comprising a plurality of block members provided in an assembled state wherein at least two block members are provided in contact to form a retaining wall of a desired orientation. The plurality of block members comprise an inner face adapted for retaining a fill material, an outer face, an upper end, a lower end and a predetermined thickness between said inner and outer face. The upper end comprises a first elongate channel and a second elongate channel spaced apart and extending substantially parallel along the upper end. A reinforcing member is provided that comprises a plurality of longitudinal tensile members and plurality of lateral tensile members, wherein the longitudinal tensile members are provided substantially perpendicular to the lateral tensile members. At least one lateral tensile member is provided in said first elongate channel and said second elongate channel such that the reinforcing member and the plurality of block members are provided in force transmitting communication.

These and other advantages of the disclosed inventions will be apparent from the disclosure of the inventions contained herein. The above-described embodiments, objectives and configurations are neither complete nor exhaustive. As will be appreciated, other embodiments of the inventions are possible using, alone or in combination, one or more of the features set forth above or described in detail below. Further, the Summary of the Invention is neither intended nor should it be construed as being representative of the full extent or scope of the present inventions. Rather, the present inventions are set forth in various levels of detail in the Summary of the Invention, as well as, in the attached drawings and the Detailed Description of the Inventions and no limitation as to the scope of the present inventions is intended by either the inclusion or non-inclusion of elements, components, etc. in this Summary of the Invention. Additional aspects of the present invention will become more readily apparent from the Detailed Description, particular when taken together with the drawings.

BRIEF DESCRIPTION OF THE DRAWINGS

The accompanying drawings, which are incorporated in and constitute part of the specification, illustrate embodiments of the invention and together with the general description of the invention given above and the detailed description of the drawings given below, serve to explain the principle of these inventions.

Figure 1:
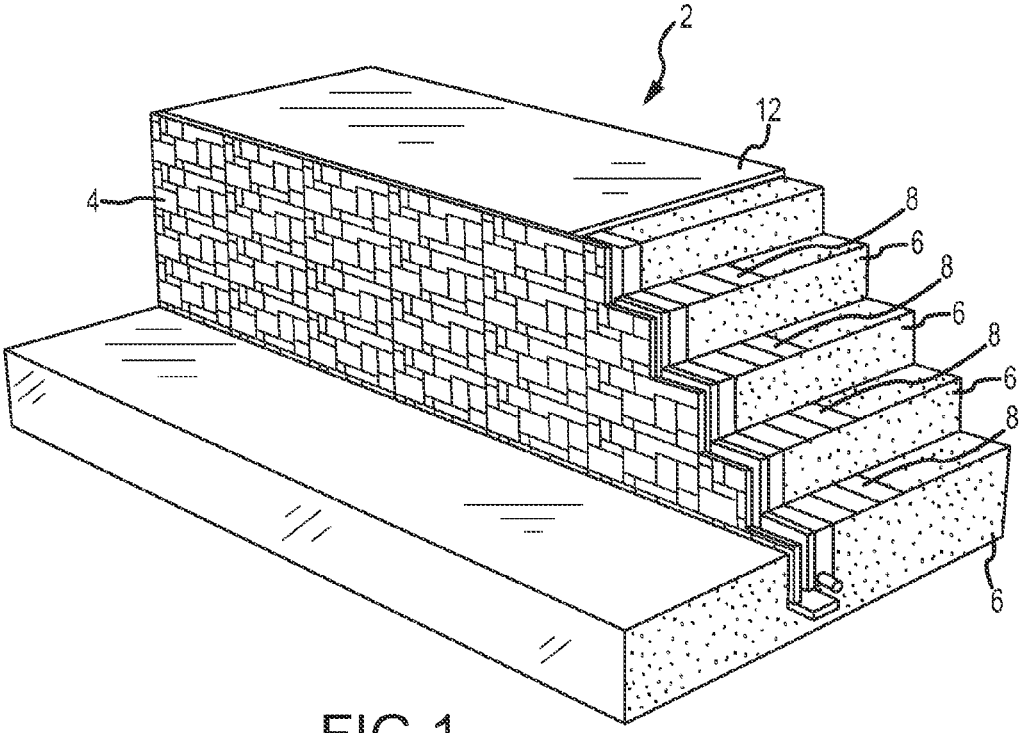
FIG. 1 is a cross sectional isometric view of one embodiment of the present invention, illustrating components of the embodiment in an assembled state.

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION OF THE INVENTION

Referring now to FIG. 1, a retaining wall system according to one embodiment of the present invention is provided. As shown, a retaining wall 2 is provided and comprises a plurality of blocks 4. The retaining wall 2 of FIG. 1 is provided as a substantially vertical planar element for containing a fill material 6. The term "fill" as used herein refers to a broad array of fill contents to be contained or restrained by a wall. Fill 6 includes, but is not limited to earthen materials, rock, sand, natural and artificial materials, and various combinations thereof. Accordingly, no limitation with respect to types of fill 6 is provided herein.

As shown in FIG. 1, a retaining wall 2 comprising a plurality of blocks 4 is adapted to retain a fill material 6, which may further comprise a cover layer 12 such as grass, turf, artificial turf, carpet, etc. One or more tieback members 8 are provided as generally extending from rows of blocks 4, the rows of blocks 4 extending in a horizontal direction and stacked in a vertical direction. Tieback members 8, as shown and described in more detail herein, extend substantially perpendicularly from the retaining wall, are generally compressed by the fill material 6 and provide structural support to the wall member 2.

Figure 2:
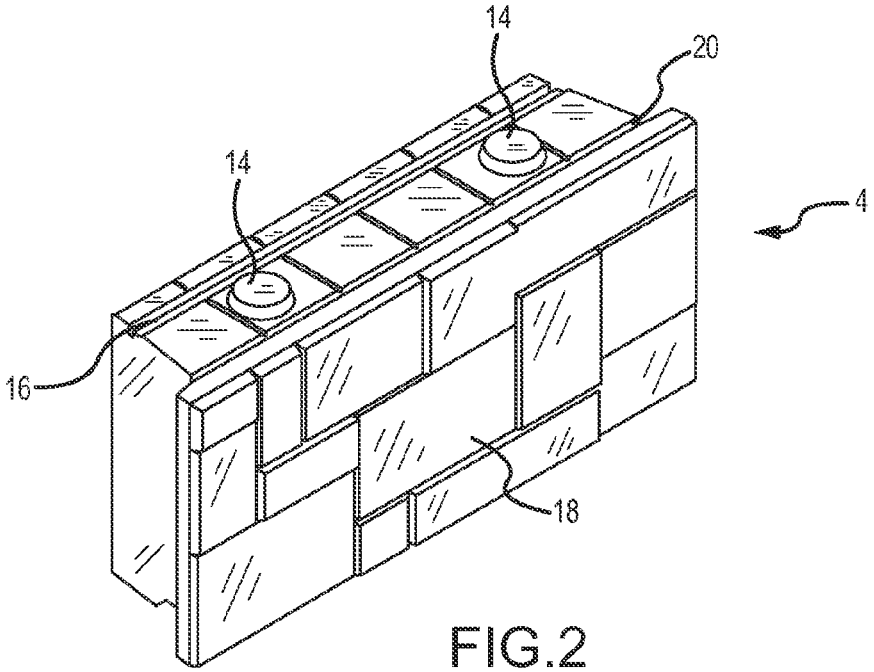
FIG. 2 is an isometric view of a component of a retaining wall according to one embodiment of the present invention.

Referring now to FIG. 2, a block member 4 according to one embodiment of the present invention is depicted. As shown, the discrete block member 4 comprises a generally rectangular shape having generally planar top, bottom, front, back, and side surfaces. The front face 18 of the block member 4 may comprise various surface ornamentation, including but not limited to stone, block, brick, as well as other patterns that may be aesthetically desirable and as will be recognized by one of ordinary skill in the art. In the depicted embodiment, a front or exposed surface 18 of the wall assembly 2 comprises a texture or ornamentation. As shown in FIG. 2, the surface 18 of the assembly 2 comprises at least the appearance of an assembly of irregularly sized blocks. It will be recognized, however, that the present invention is not limited to any particular appearance, texture, shape, material, or ornamentation of the exposed surface 18.

Block members 4 of the present invention preferably comprise at least one projection 14 for stacking and joining blocks 4. In the embodiment of FIG. 2, the block member 4 comprises two projections 14 provided on an upper surface of the block 4, the projections 14 are provided for receiving another block 4 or similar feature comprising a female-interface adapted to receive the projections 14. Preferably, female-interface portions or depressions (not shown in FIG. 2), are provided on a bottom portion of the blocks 4 and generally comprise an inverse or corresponding feature to the projection(s) 14. Connection of the projection(s) 14 and the depressions aid in assembling and aligning the blocks, and also restrict movement of the assembled unit 2.

As shown in FIG. 2, and described in more detail herein, the assembly 2 comprises at least one anchor receiving channel 16 extending transversely along the blocks 4 and the assembly 2. In various embodiments, each block 4 comprises a discrete component of a wall assembly 2 provided with a channel 16 and wherein proper assembly of the blocks 4 create at least one continuous transverse slot or channel 16 for receiving an anchor tieback member.

The block member 4 of the embodiment of FIG. 2 may further comprise a void within the block to reduce the weight of the block 4. As shown in FIG. 2, a block 4 comprises a generally rectilinear member having a volume. At least a portion of the volume is hollow, thus creating an internal void. The internal void preferably reduces the weight of the block 4 without significantly decreasing structural integrity of the block 4 and assembled retaining wall system 2. In certain embodiments, the internal void comprises a substantially sealed portion of the block 4 that is not accessible. In alternative embodiments, the internal void 25 may be filled, such as with water, dirt, etc. to reinforce the block 4 and/or increase the weight of the resulting structure 2.

Figure 3:
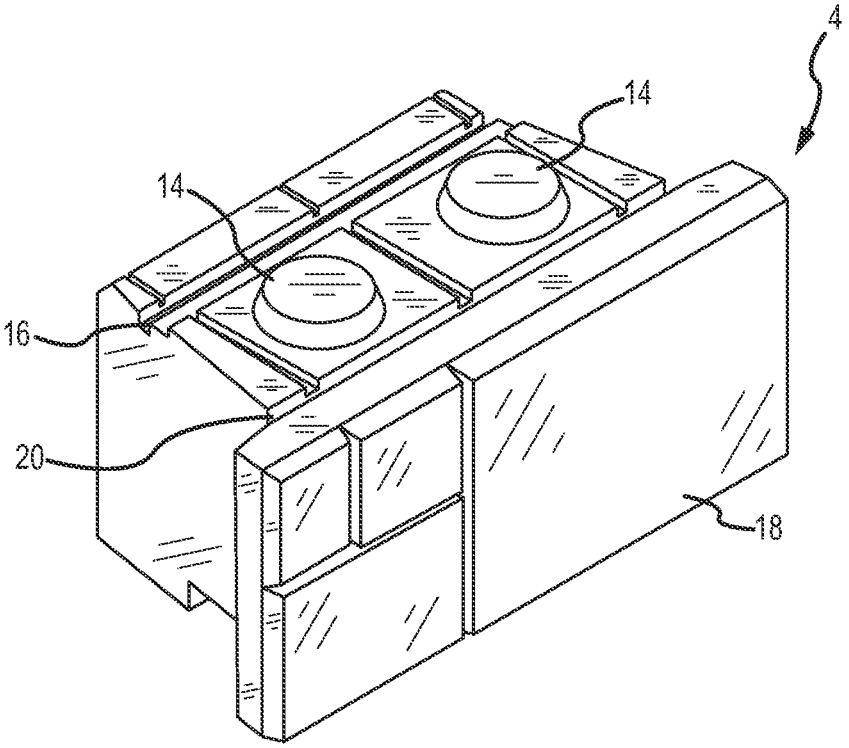
FIG. 3 is an isometric view of a component of a retaining wall according to one embodiment of the present invention.
Figure 4:
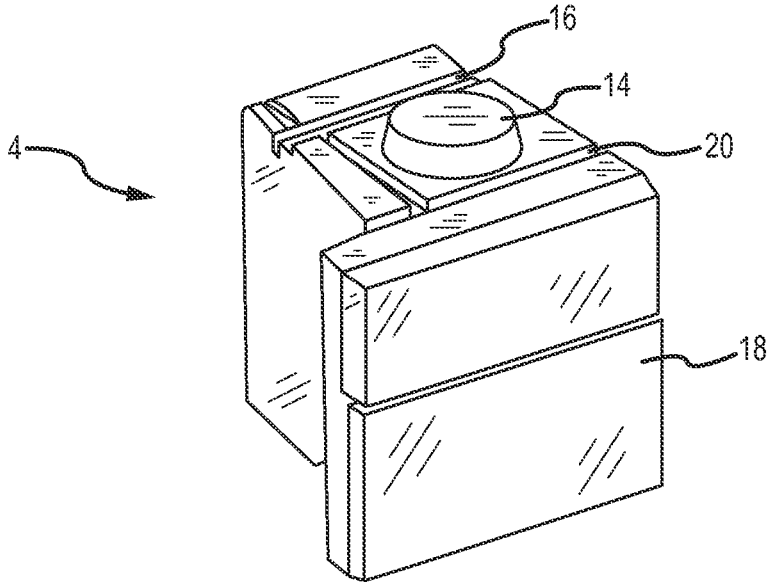
FIG. 4 is an isometric view of a portion of the component of the embodiment of FIG. 3.

FIGS. 3 and 4 are perspective views of block members 4 of different sizes and/or configurations. FIGS. 3-4 provide perspective views of a block 4 according to embodiments of the present invention. As shown, the block 4 comprises a plurality of projections 14 for receiving and stabilizing an adjacent block 4, an anchor receiving channel 16, and a front face 18. Blocks 4 of various embodiments and the corresponding assembled wall structure 2, comprise channel-like void members 20 that reduce the overall weight of the blocks 4 and wall assembly 2 and allow for earthen soil or backfill material to be placed or packed into the voids and thereby assist in retaining the blocks in a fixed position. In various embodiments, a void 20 is provided with each block 4, the void 20 being positioned behind a front face 18 of the block 4. Voids 20 may be of various construction, size, shape, etc., particularly where the voids 20 are designed to reduce the weight of the block 4 and receive fill material to stabilize the wall structure. In certain embodiments, voids 20 are provided on block elements 4 wherein the voids 20 are sized to receive a portion of an adjoining block member 4. In such embodiments, the void comprises a preferred shape and serves as a female element within which a corresponding male portion of one or more adjacent blocks interface. For example, in certain embodiments, blocks 4 are provided with voids 20 that are elongate or channel-like V-shaped or U-shaped members and wherein adjacent blocks comprising corresponding projections are provided.

Figure 5:
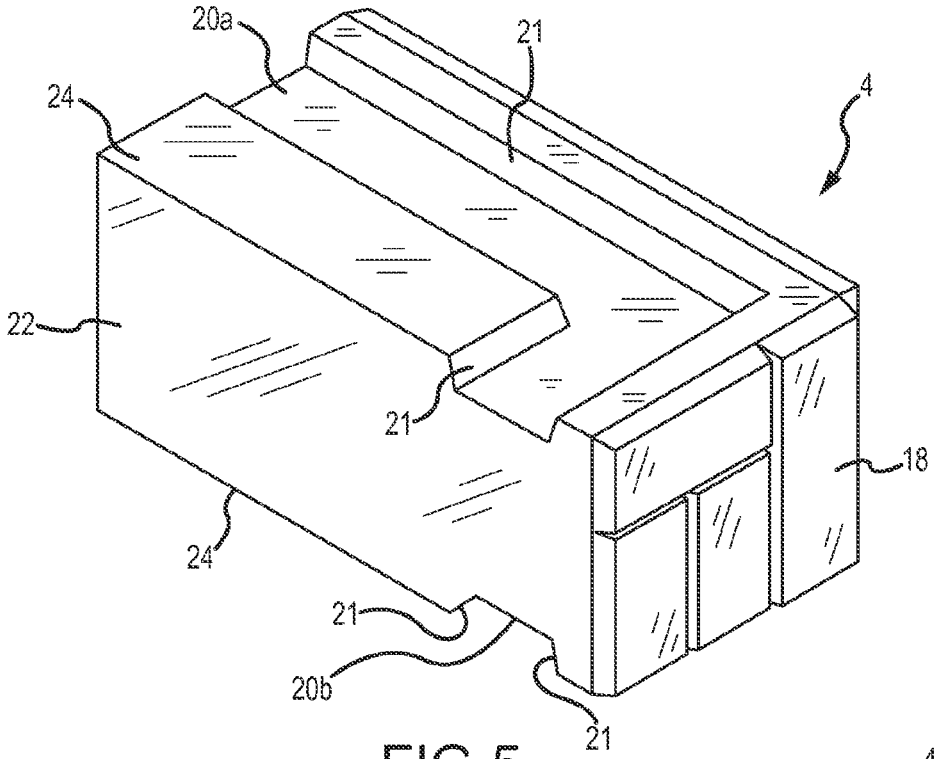
FIG. 5 is an isometric view of a component of a retaining wall according to one embodiment of the present invention, the component comprising a reversible corner block.

FIG. 5 is a perspective view of a block member 4 comprising a first void 20*a* and a second void 20*b* extending along at least two dimensions of the block 4. The void members 20*a*, 20*b* comprise a trough with angled sidewalls 21 extending from a bottom of the void 20 to upper and lower planar surfaces 24 of the block 4. The block 4 comprises an inwardly extending member 22, which generally extends inwardly from the front face 18 of the block 4. The voids 20*a*, 20*b* may be of any depth and/or width. The voids 20*a*, 20*b* are adapted to receive a fill material and reduce the weight of the block 4. However, one or more adjacent blocks 4 may be provided with male protrusion or extension members that are adapted to communicate with one of the voids 20*a*, 20*b*.

Figure 6:
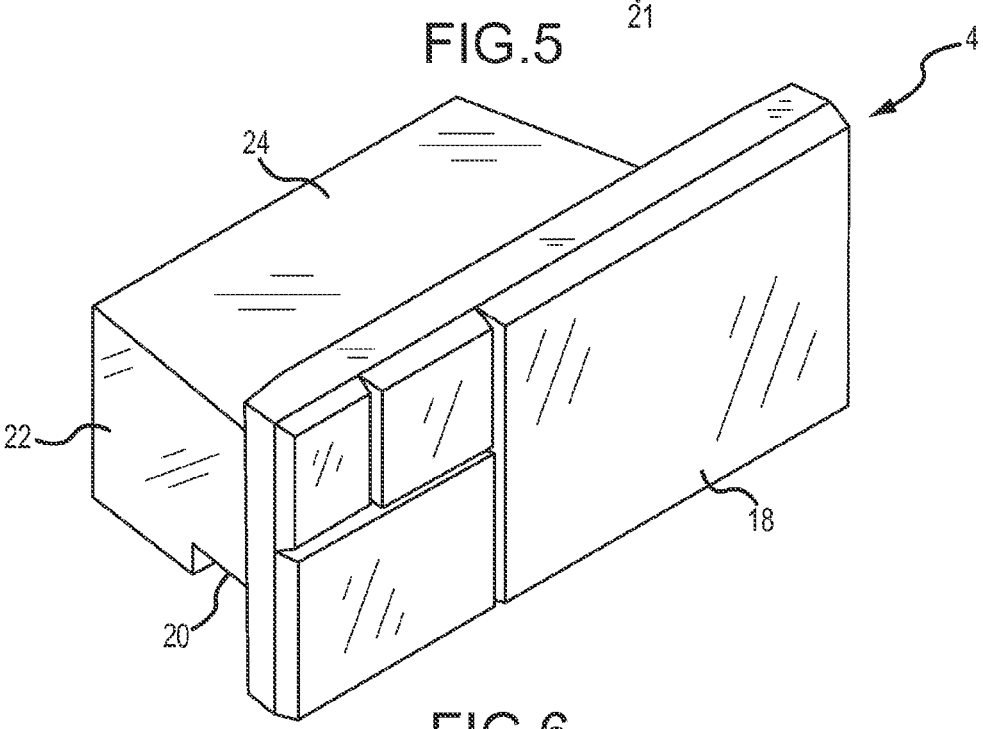
FIG. 6 is an isometric view of a component of a retaining wall according to one embodiment of the present invention, the component comprising a block feature.

FIG. 6 is a perspective view of a block 4 according to an alternative embodiment wherein the inwardly extending member 22 of the block 4 comprises a single void 20 and wherein the void 20 is provided on a lower surface of the inwardly extending member 22. The void 20 of the embodiment of FIG. 6 is provided to receive a corresponding projection of an adjacent block (not shown) and thereby increase the ease of assembly and/or secure adjacent blocks together. Alternatively, the void 20 may comprise a receptacle for fill material such as earthen fill and/or serve as a conduit or drainage passage for fluids.

Figure 7:
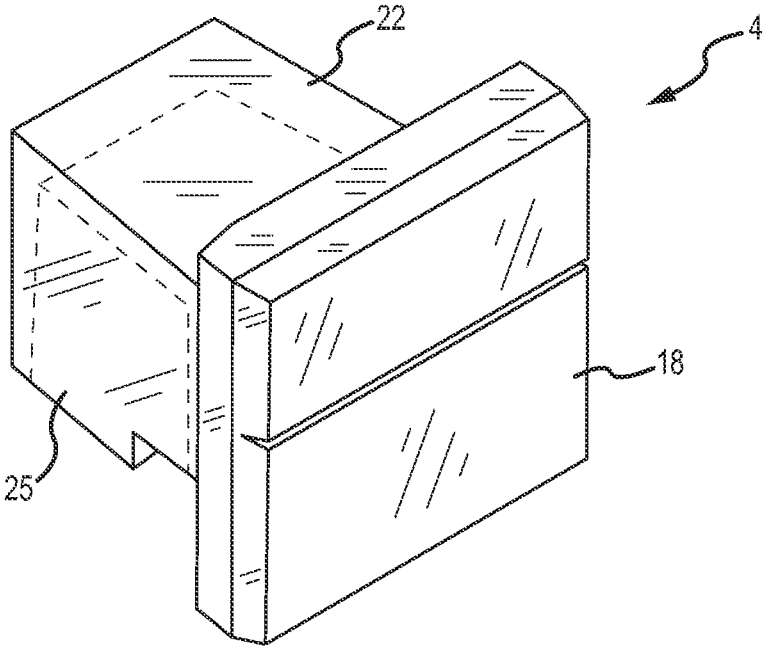
FIG. 7 is an isometric view of a component of a retaining wall according to one embodiment of the present invention, the component comprising a block feature.

FIG. 7 is a perspective view of a block member 4 of one embodiment of the present invention wherein the block member 4 comprises an internal void or recess 25. As shown in FIG. 7, an inwardly extending member 22 comprises a generally rectilinear member having a volume. At least a portion of the volume is hollow, thus creating an internal void 25. The internal void 25 preferably reduces the weight of the block 4 without significantly decreasing structural integrity of the block 4 and assembled retaining wall system 2. In certain embodiments, the internal void 25 comprises a substantially sealed portion of the block 4 that is not accessible. In alternative embodiments, the internal void 25 may be filled, such as with water, dirt, etc. to reinforce the block 4 and/or increase the weight of the resulting structure 2.

Figure 8:
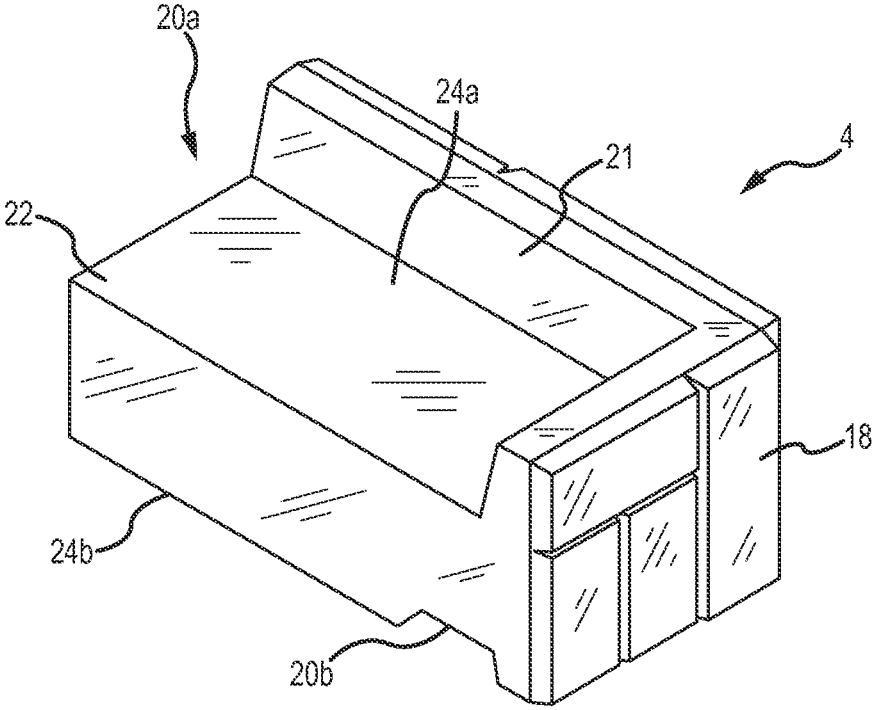
FIG. 8 is an isometric view of a component of a retaining wall according to one embodiment of the present invention, the component comprising a top corner block feature.

FIG. 8 is a perspective view of a block 4 according to one embodiment of the present invention. As shown, the block 4 comprises an inwardly extending portion 22 extending inwardly from an outer surface 18 and wherein the inwardly extending portion 22 comprises an upper void 20*a* and a lower void 20*b*. The upper void 20*a* and a lower void 20*b* are of different construction. Specifically, the lower void member 20*b* comprises a channel member extending in at least one direction of the block 4. The upper void 20*a* comprises a recessed area with upwardly extending sidewalls 21. A lower void 20*b* may comprise a channel or slot-like member 20*b* as shown and described herein. Alternatively, the upper 20*a* and lower 20*b* voids may comprise voids of substantially the same constructions and/or be mirror images of one another.

Figure 9:
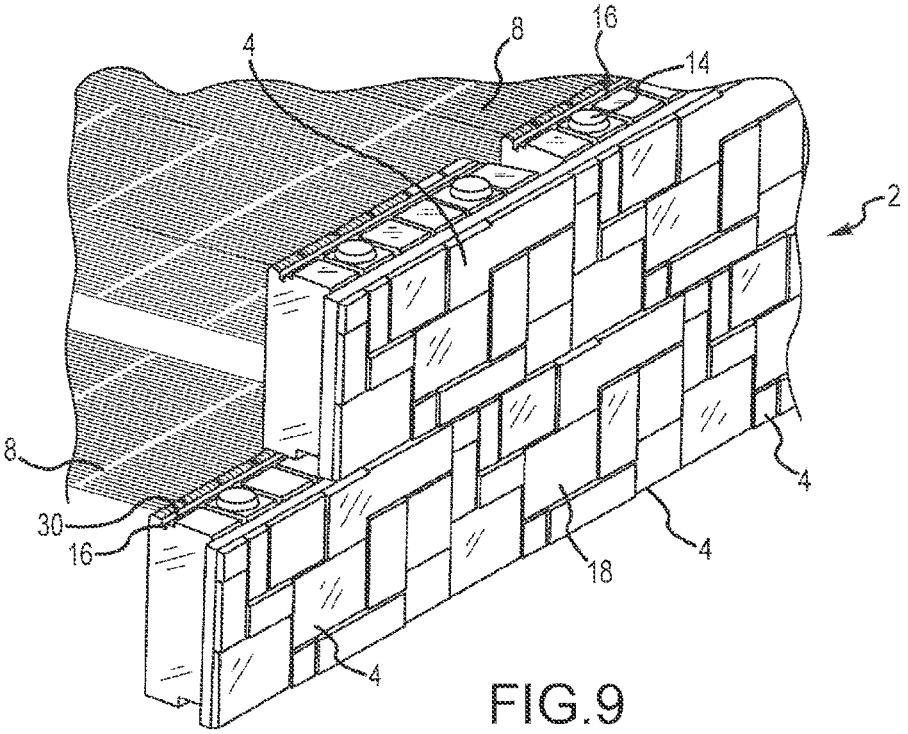
FIG. 9 is an isometric view of a retaining wall system according to one embodiment provided in an assembled state.

FIG. 9 is a perspective view of one embodiment of the present invention comprising an assembled retaining wall structure 2 with a plurality of tieback members 8 secured thereto. As shown, a retaining wall system 2 comprises a plurality of block members 4 in an assembled state. The system 2 may comprise any number of blocks 4 of any construction of the various embodiments shown and described herein. An outer surface 18 comprises an ornamental appearance, such as the appearance of a stone assembly of stones or objects of various sizes provided in an arrangement. A plurality of tieback members 8 is secured to the wall system and extending rearward with respect to the outer surface portion 18. The tieback members 8 may be provided in communication with and/or compressed by a fill material to help prevent the system 2 from undesired movements. The tieback members 8 are secured to the wall system 2 by a connecting anchor 30 provided in an anchor receiving channel 16. In various embodiments, connecting anchors 30 are interconnected with the tieback members 8 and the connecting anchors are secured to the system 2 via the receiving channel 16. In certain embodiments, block elements may be stacked upon the receiving channel 16 and/or connecting anchor 30 to secure the tieback 8 and associated elements in place and prevent pull-out of the tieback.

Figure 10:
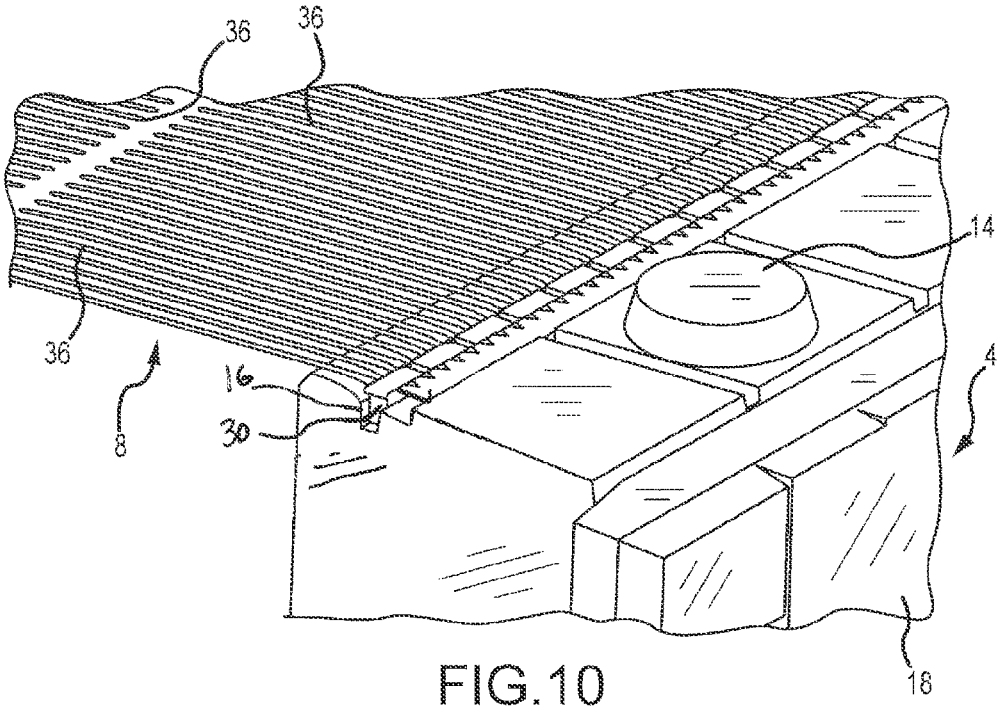
FIG. 10 is an isometric view of a retaining wall system with tieback elements in an assembled state according to one embodiment of the present invention.

FIG. 10 is a detailed perspective view of the retaining wall assembly 2 of the embodiment of FIG. 9. As shown, the system 2 comprises an anchor receiving channel 16 and a connecting anchor 30 provided therein to secure a tieback member 8 to the wall assembly 2. As shown, the tieback member 8 generally comprises a "geogrid" mesh. Such a member, which may be described or provided as a "uniaxial geogrid", comprises a plurality of elongate channels or slots 36. These elongate channels 36 receive components and features of certain embodiments of the present invention as shown and described herein. The elongate channels 36 provided in connection with the anchor(s) 30 of FIG. 11 create an interconnection with the anchor(s) 30 and the wall panel as shown and described herein.

Figure 11:
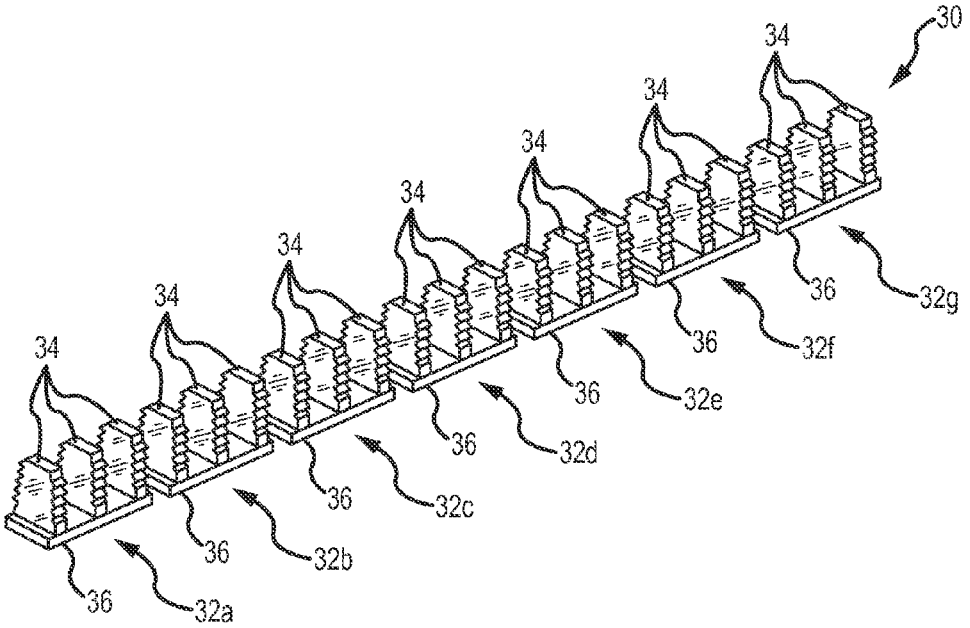
FIG. 11 is an isometric view of a connection anchor in isolation and according to one embodiment of the present invention.

FIG. 11 is a perspective view of a connecting anchor 30 according to one embodiment of the present invention. As shown, the connecting anchor 30 comprises a plurality of discrete segments 32*a*, 32*b*, 32*c*, 32*d*, 32*e*, 32*f*, 32*g*, wherein each of the discrete segments 32 comprise extensions 34 or ridge members extending from a base portion 36. The connecting anchor 30 preferably comprises a plurality of segments 32 such that the anchor 30 can be easily assembled and form any desired length. The tabs 34 are adapted to receive and secure a grid-like mesh, and preferably extend downwardly into a receiving channel (see, e.g., 16 of FIG. 3). In various embodiments, the tabs 34 extend approximately equal to or less than a depth of a corresponding receiving channel and provide multiple contact points for receiving a tension force provided by a tieback member 8 and associated elements.

It will be recognized that the terms "tieback members" and/or "tiebacks" as used herein refer to various members suitable for extending from an interior portion of a retaining wall and supporting the same. In certain embodiments, tieback members 8 comprise geogrid material that can be made from materials including but not limited to, polymers such as polyester, polyethylene or polypropylene, and various similar materials and combinations thereof. The tiebacks may be woven or knitted from yarns, heat-welded from strips of material, or produced by molding or punching a regular pattern of openings, such as holes, in sheets of material, which can then stretched and thereby creating a grid sheet. Tiebacks can also be manufactured by bonding together polyester or polypropylene rods or straps in a grid like pattern using laser or ultrasonic technologies.

Figure 12:
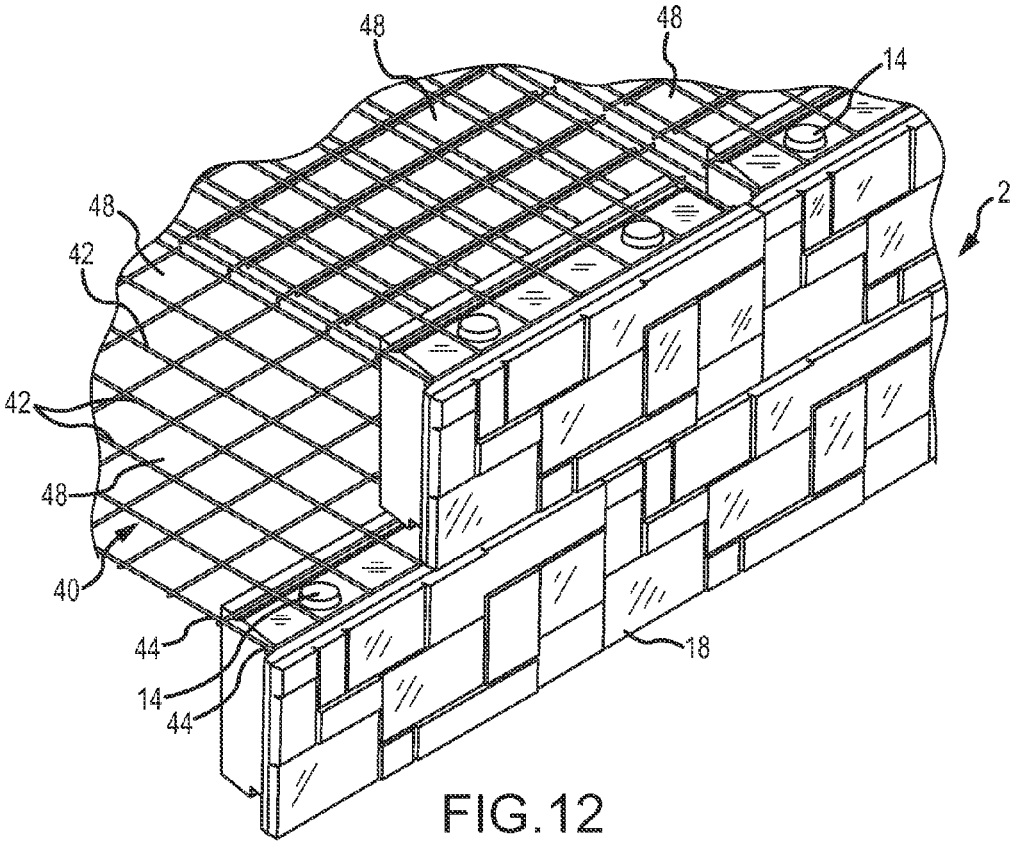
FIG. 12 is an isometric view of an alternate embodiment of the present invention comprising a wire mesh tieback provided in an assembled state and according to one embodiment of the present invention.
Figure 13:
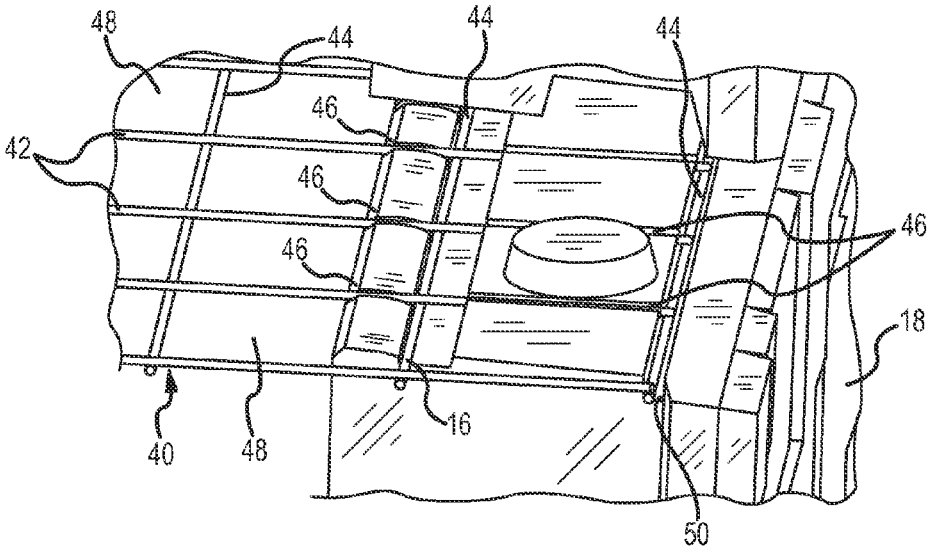
FIG. 13 is a detailed isometric view of the embodiment of FIG. 12.

FIGS. 12-13 depict a retaining wall assembly 2 comprising a plurality of blocks 4 and further comprising a tieback member 40. The tieback member 40 of the depicted embodiment comprises a substantially planar grid member comprising substantially perpendicular members, such as bars or strands. A first plurality of members is provided comprising longitudinal tensile members 42 and lateral tensile members 44. The combination of longitudinal tensile members 42 and lateral tensile members 44 provides a grid with apertures 48. The grid tieback 40 is adapted to receive a fill material and provide a tension to the wall system to prevent undesired movement of, and generally support the retaining wall system 2. The tieback 40 of the embodiment of FIGS. 12-13 is secured to the block member(s) 4 of the retaining wall 2 by providing lateral members 44 within a first anchor receiving channel 16 and a second anchor receiving channel 50. In various embodiments, the second anchor receiving channel 50 comprises a void as shown and described herein. In alternative embodiments, first 16 and second 50 anchor receiving channels comprise elongate recesses sized specifically to receive a particular diameter of the lateral tensile members 44. Tensile members may be secured within the anchor receiving channels by any one or more of welding, press-fitting, and/or stacking wherein additional blocks and/or fill are provided on top of the tensile members 44. Although the embodiments of FIGS. 12-13 depict a wall system 2 comprising two anchor receiving channels, it will be expressly recognized that any number of channels may be provided. Preferably, the channels 16, 50 are spaced apart at substantially the same distance as a distance between lateral tensile members 44.

Figure 14:
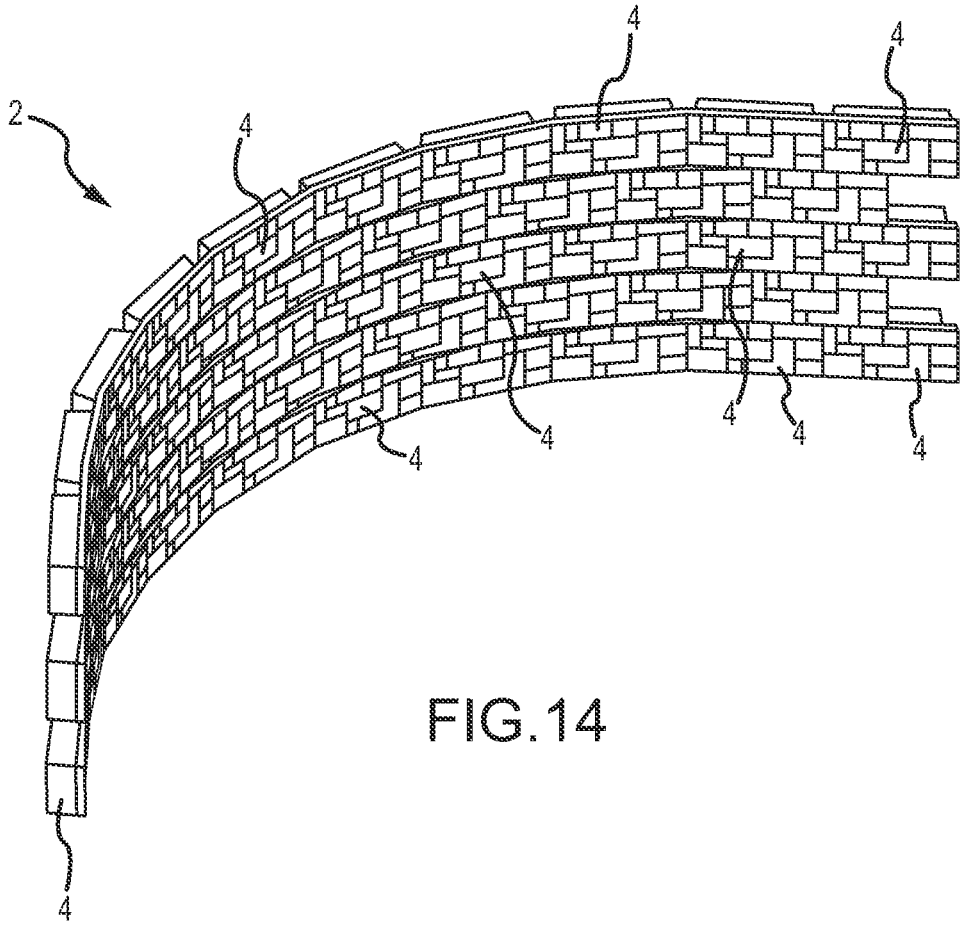
FIG. 14 is an isometric view of a curved retaining wall assembly according to one embodiment of the present invention and provided in an assembled state.

FIG. 14 is a perspective view of one embodiment of the present invention wherein a retaining wall system 2 comprises a curvature about one or more radii. Various features of the present invention including, for example, circular projections 14 allow for individual blocks 4 to be assembled in a curved manner. Additionally, the present invention contemplates providing tieback elements 8 that may be angled or tapered such that a rounded or curved section of the wall system 2 may further comprise a tieback member 8.

Figure 15:
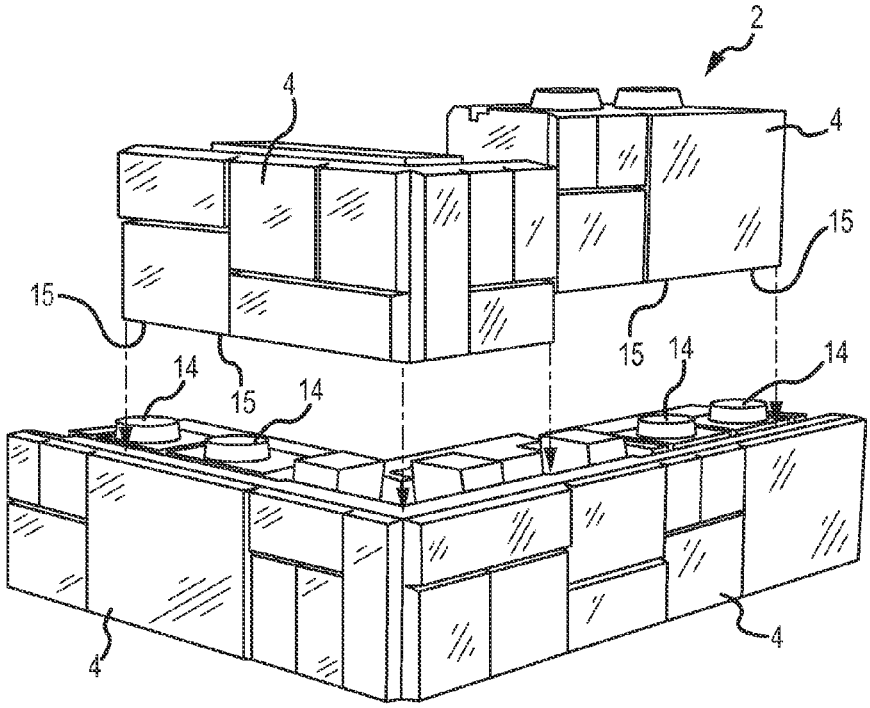
FIG. 15 is an isometric view of a plurality of restraining wall components provided in a partially assembled state and according to one embodiment of the present invention.
Figure 16:
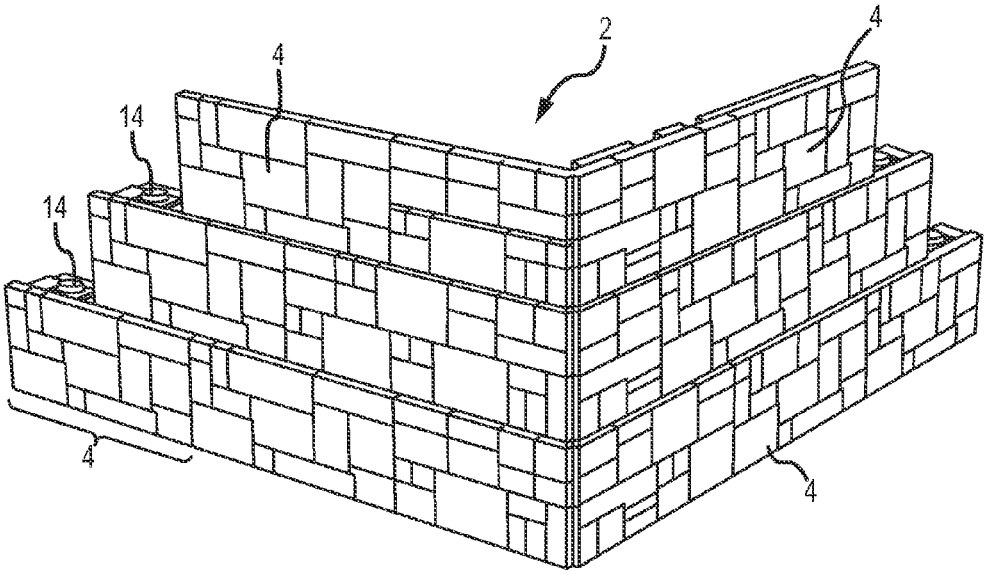
FIG. 16 is an isometric view of a plurality of restraining wall components provided in a partially assembled state and according to one embodiment of the present invention.

FIGS. 15-16 are perspective views of one embodiment of a retaining wall system 2 comprising a plurality of blocks 4. The wall of the embodiment of FIG. 15 comprises a ninety-degree right angle. Embodiments of the present invention contemplate providing block members 4 with various angles provided therein such that blocks 4 may be selected and assembled to provide various angles including but not limited to right angled corners.

Figure 17:
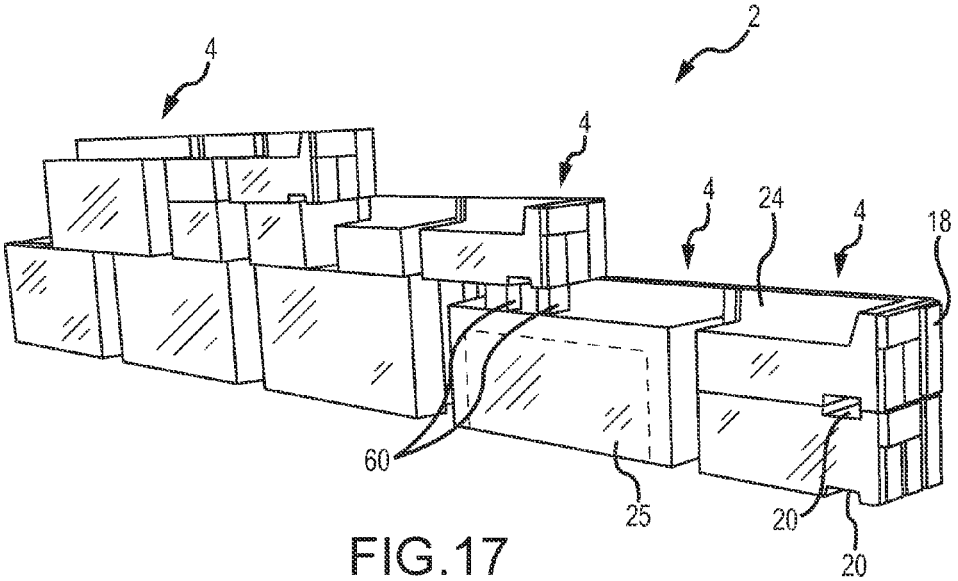
FIG. 17 is a rear isometric view of restraining wall components provided in a partially assembled state according to one embodiment of the present invention.
Figure 18:
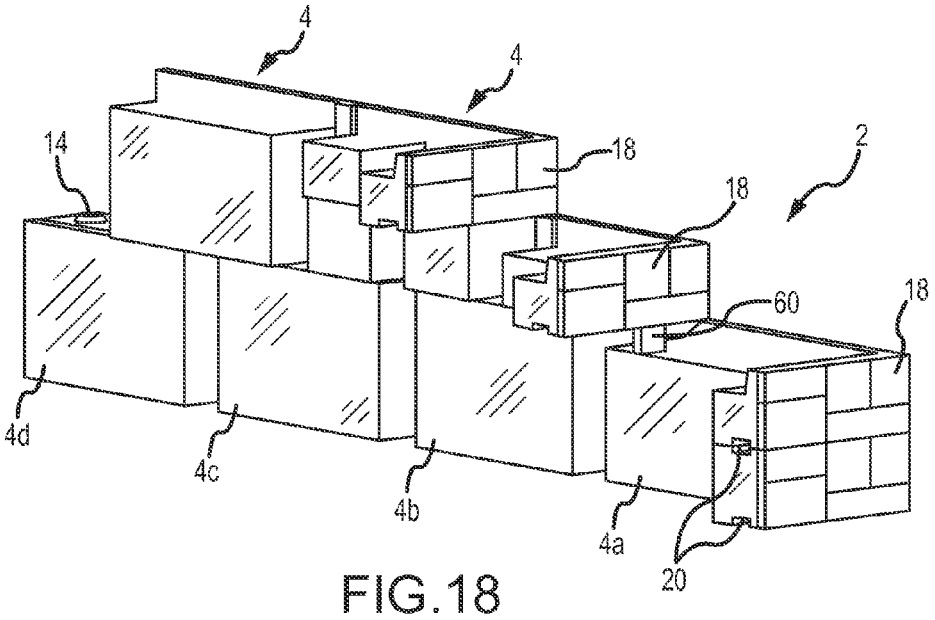
FIG. 18 is a rear isometric view of restraining wall components provided in a partially assembled state according to one embodiment of the present invention.

FIGS. 17-18 are rear perspective views of retaining wall assemblies 2 according to various embodiments of the present invention. The retaining wall structures 2 are formed of a plurality of modular block elements 4 in a stacked and/or connected arrangement. Blocks of different construction as shown and described herein, including blocks 4 with weight reducing voids 25 and channel-like void members 20 are provided together in combination to form a wall 2 of desired size, shape and functionality. In the embodiment of FIG. 17, channel-like voids 20 are provided adjacent to each other to form a channel through a portion of the wall 2. The resulting channel may be filled to increase weight and stabilize the wall, or may be provided as a conduit for directing water and fluid. The embodiment of FIG. 17 further provides connector block member 60 that are provided as spacers between blocks 4 that are of different sizes and/or positioned on different elevations. FIG. 18 depicts a wall assembly 2 of different construction and wherein a plurality of block members 4 are selectively assembled and wherein at least some of the block members comprise different shapes, sizes, and/or features. Accordingly, and assortment of blocks 4 and associated features may be selectively combined in various embodiments of the present invention to form a wall structure 2 of desired size, shape, orientation, etc. The wall structure 2 may be formed so as to provide a stepped or terraced structure. Draining features, such as voids 20 and other internal spacing may be provided in such embodiments and constructions to promote fluid flow and drainage in desired locations of the retaining wall 2.

Figure 19:
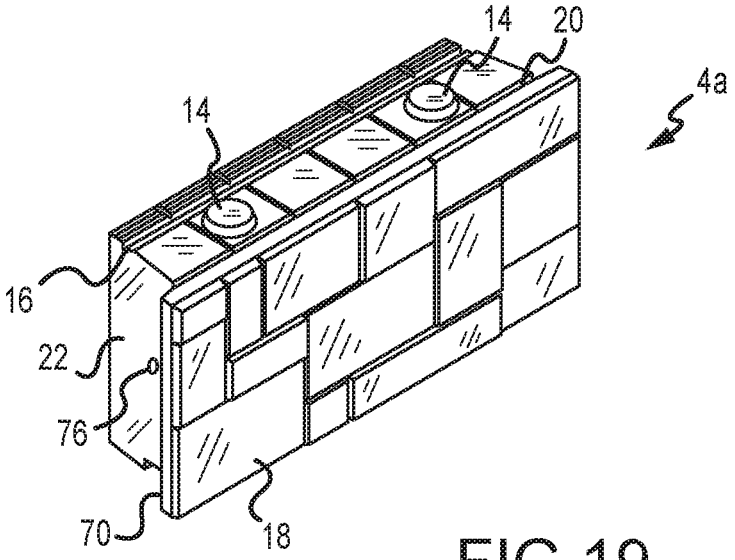
FIG. 19 is a top perspective view of a block member according to one embodiment of the present invention.

FIG. 19 is a perspective view of a block member 4*a* of one embodiment of the present invention. The block member 4 is provided in an isolated, unassembled state. As shown, the block 4 comprises projections 14 extending from an upper surface of the block. The projections 14 of the embodiment of FIG. 19 comprise two upstanding frustoconical projections. It will be recognized that any number of projections of various sizes and shapes may be provided. The block 4 further comprises a front surface 18, a connecting anchor channel 16, a channel-like void member 20, and an inwardly extending portion 22. The front portion of surface 18 of the block 4 comprises a lip or flange 70 and the inwardly extending portion comprises a smaller cross-sectional area than the front surface 18. Apertures 76 for receiving connectors from adjacent blocks may be provided in peripheral sides of the inwardly extending portion 22. The flange 70 may be broken or scored off to size the block 4 as desired. In various embodiments, score lines are provided on an interior surface of the flange 70 to assist in breaking or resizing a block 4.

Figure 20:
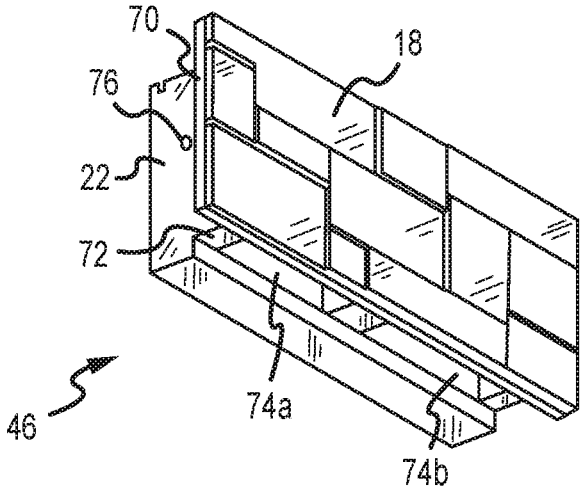
FIG. 20 is a bottom perspective view of a block member according to one embodiment of the present invention.

FIG. 20 is a bottom perspective of a block 4*b* according to one embodiment of the present invention. The block 4*b* of the depicted embodiment may be the same as the block of FIG. 19 and comprise the same features on an upper region of the block. Alternatively, the block 4*b* comprises upper portion features of a different embodiment. As shown, the block 4*b* comprises a lower region with a recessed trough 72 and elongate voids 74*a*, 74*b* for receiving projections 14 of an adjacent block. In various embodiments, a block 4 comprises voids that directly correspond to the shape of male projecting features 14. In alternative embodiments, and as shown in FIG. 20, the elongate voids 74*a*, 74*b* comprise square or oval voids that are adapted to receive projections but do not comprise an inverse shape of the projection(s) 14. The slots or voids 74*a*, 74*b* of the embodiment of FIG. 20 provide for lateral adjustability of multiple when in an assembled or at least partially assembled state.

Figure 21:
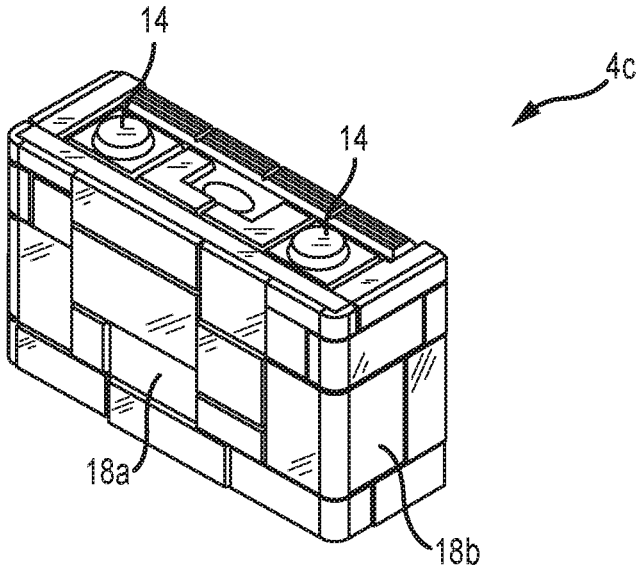
FIG. 21 is a top perspective view of a block member according to one embodiment of the present invention.

FIG. 21 is a perspective view of a block 4*c* of one embodiment of the present invention. As shown, the block 4*c* comprises first and second surface portions 18*a*, 18*b* wherein both portions are adapted to be displayed or provided on an external surface. The block 4*c* of FIG. 21 is thus adapted and/or suited for use as a corner block. Projections 14 are provided on an upper surface portion of the block 4*c*.

Figure 22:
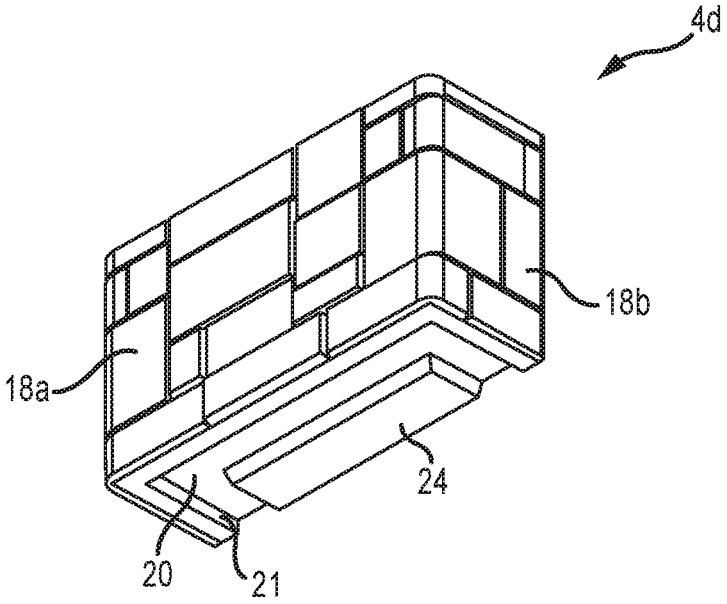
FIG. 22 is a bottom perspective view of a block member according to one embodiment of the present invention.

FIG. 22 is a bottom perspective view of a block 4*d* according to one embodiment of the present invention. The block 4*d* of the depicted embodiment may be the same as the block of FIG. 21 and comprise the same features on an upper region of the block. Alternatively, the block 4*d* comprises upper portion features of a different embodiment. As shown, the block 4*d* comprises a lower region with a trough or channel 20 and sidewalls 21 extending therefrom. The trough 20 is adapted to receive projections 14 and allow for translations of the projections and associated block 4. The block 4*d* of FIG. 22 comprise first and second 18*a*, 18*b* surface features.

Figure 23:
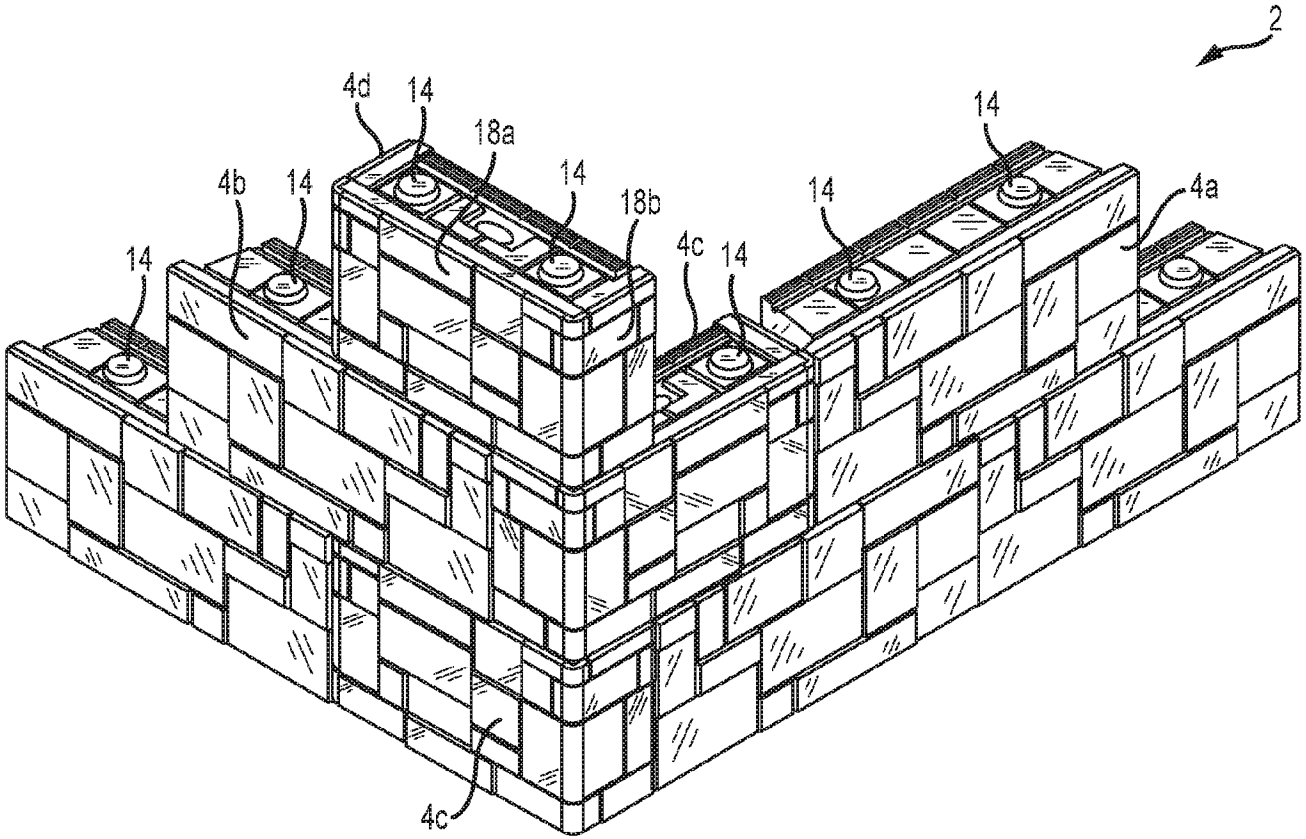
FIG. 23 is a perspective view of a wall assembly according to one embodiment of the present invention.
Figure 24:
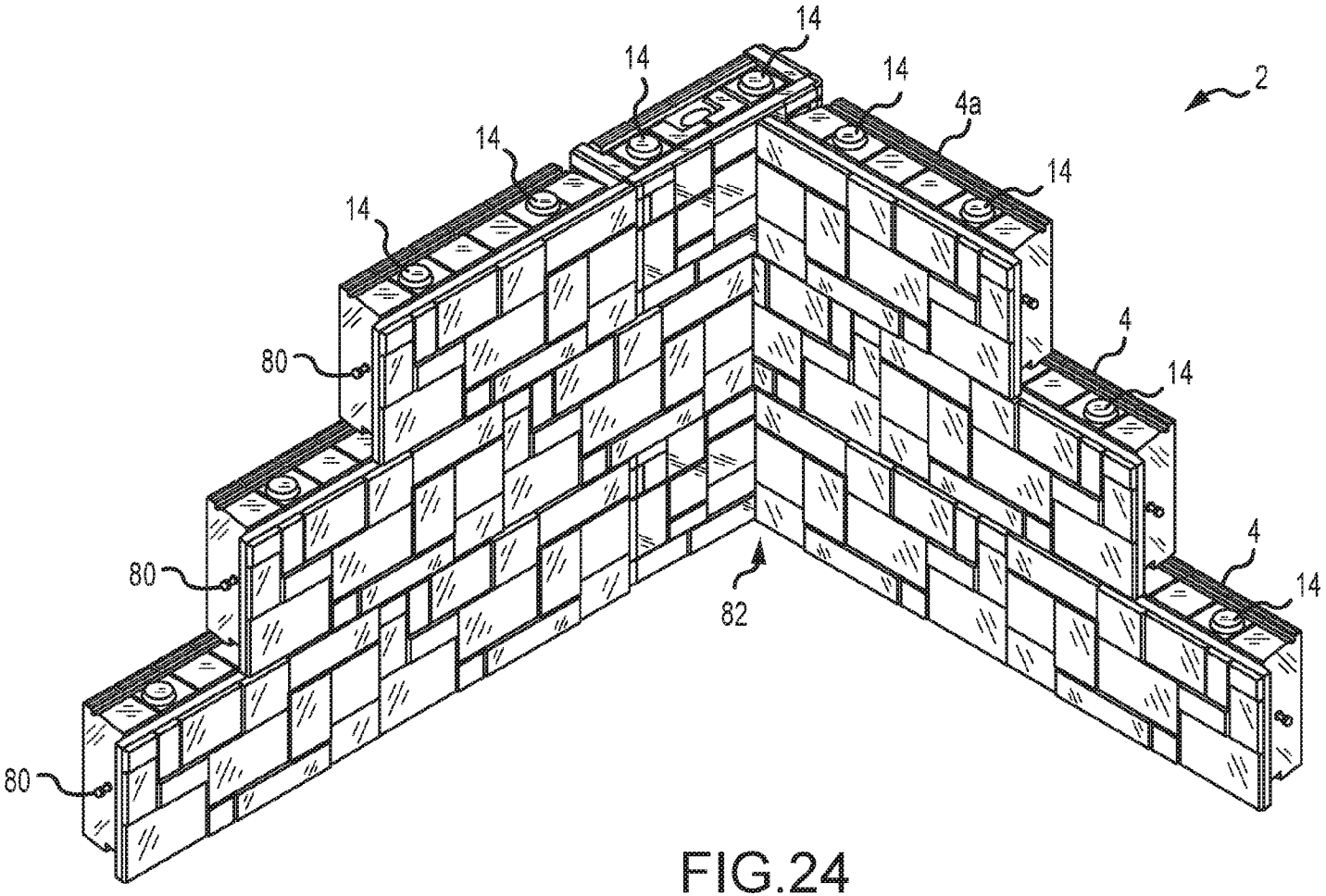
FIG. 24 is a perspective view of a wall assembly according to one embodiment of the present invention.

FIG. 23 is a perspective view of a retaining wall assembly 2 according to one embodiment of the present invention. As shown, the wall 2 comprises block members 4*a*, 4*b*, 4*c*, 4*d* provided in an interconnected manner. The assembly 2 comprises a corner or right angle portion which is made possible at least in part by the provision of corner block members 4*c*, 4*d* as shown and described herein. FIG. 24 is a perspective view of a wall assembly 2 according to another embodiment of the present invention and wherein in internal right angle 82 is provided by the assembled blocks 4.

Modular block members of the present invention may comprise various shapes and sizes and may be assembled to form various assembly configurations. Block types include but are not limited to full blocks, quarter blocks, one-eighth blocks, corner blocks, top blocks, partial top blocks, base blocks, step blocks and various other types and/or shapes.

It is to be understood that blocks may be manufactured in a variety of shapes including but not limited to parallelogram, rectangle, rhombus, square, and trapezoid, as well as shapes having curved ends. In certain embodiments, blocks are manufactured from precast concrete. In alternative embodiments, block members are constructed of various materials including but not limited to plastic, polymer concrete, While various embodiments the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate. The dimensions of the component pieces may also vary, yet still be within the scope of the invention. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A modular retaining wall assembly, comprising:

a plurality of block members of different construction operable to be assembled in a stacked arrangement to form a retaining wall of a desired orientation;

at least some of the plurality of block members comprising an inner face adapted for retaining a fill material, an outer face comprising a surface ornamentation, an upper end, a lower end and a predetermined thickness between said inner and outer face;

the assembly comprising an elongate channel when said plurality of block members are provided in an assembled state;

a reinforcing member extending away from said plurality of block members, wherein the reinforcing member, the elongate channel, and plurality of block members are provided in force transmitting communication; and a connecting anchor comprised of a first end and a distal end, said distal end operably sized to engage said elongate channel and secure the reinforcing member to said plurality of block members, the connecting anchor extending through at least a portion of the reinforcing member;

at least some of the plurality of block members comprising voids, and wherein the voids are operable to reduce the weight of the block members or provide a conduit for directing water and fluid;

the wall assembly comprising at least one connector block member in the form of a spacer provided in at least one of the voids;

at least some of the plurality of block members comprising corner blocks, the corner blocks comprising first and second surface portions provided at right angles and wherein each of the first and second surface portions comprise a surface ornamentation adapted to be displayed or provided as an external surface.

2. The modular retaining wall system of claim 1, wherein said reinforcing member comprises a substantially planar grid.

3. The modular retaining wall system of claim 1, wherein said connecting anchor comprises a base member and a plurality of extensions.

4. The modular retaining wall system of claim 3, wherein said plurality of extensions are provided through a portion of said reinforcing member to secure said reinforcing member to said connecting anchor and/or said plurality of block members.

5. The modular retaining wall system of claim 1, wherein at least one of said plurality of block members comprises a frustoconical projection extending upwardly from an upper surface for engaging a recess on a lower portion of a block positioned immediately above said plurality of block members.

6. The modular retaining wall system of claim 1, wherein at least one of said plurality of block members comprises a plurality of projections.

* * * * *